US011674771B2

(12) United States Patent
Wilson

(10) Patent No.: US 11,674,771 B2
(45) Date of Patent: Jun. 13, 2023

(54) SUPPRESSOR FOR A GUN

(71) Applicant: Bert John Wilson, Hamilton (NZ)

(72) Inventor: Bert John Wilson, Hamilton (NZ)

(73) Assignee: OCEANIA DEFENCE LTD, Tauranga (NZ)

( * ) Notice: Subject to any disclaimer, the term of this patent is extended or adjusted under 35 U.S.C. 154(b) by 0 days.

(21) Appl. No.: 17/688,392

(22) Filed: Mar. 7, 2022

(65) Prior Publication Data

US 2022/0276017 A1 Sep. 1, 2022

Related U.S. Application Data

(63) Continuation of application No. 16/768,561, filed as application No. PCT/NZ2019/050153 on Nov. 26, 2019, now Pat. No. 11,268,778.

(30) Foreign Application Priority Data

Nov. 26, 2018 (NZ) ..... 748689

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 1,017,003 | A * | 2/1912 | Kenney | F41A 21/30 89/14.4 |
| 9,347,727 | B1 * | 5/2016 | Cler | F41A 21/30 |
| 10,739,097 | B1 * | 8/2020 | Gaines | F41A 21/30 |
| 10,753,699 | B2 * | 8/2020 | Klett | F41A 21/30 |
| 2015/0001001 | A1 * | 1/2015 | Wilson | F41A 21/36 219/76.1 |
| 2017/0102202 | A1 | 4/2017 | Augustine et al. | |
| 2017/0160034 | A1 | 6/2017 | Parker | |
| 2018/0038663 | A1 | 2/2018 | Larue | |
| 2018/0252489 | A1 | 9/2018 | Parker | |
| 2018/0266783 | A1 * | 9/2018 | Morreau | F41A 21/30 |
| 2021/0003360 | A1 * | 1/2021 | Kras | F41A 21/30 |

(Continued)

OTHER PUBLICATIONS

Notification of Transmittal of the International Search Report and the Written Opinion of the International Searching Authority or the Declaration dated Jan. 29, 2020 in International Application No. PCT/NZ2019/050153.

(Continued)

*Primary Examiner* — Samir Abdosh
(74) *Attorney, Agent, or Firm* — Kramer & Amado, P.C.

(57) ABSTRACT

A suppressor for a firearm comprises an inner chamber through which a projectile fired by the firearm passes along a projectile pathway through the suppressor. The suppressor further comprises a first baffle, a plurality of apertures at an outer perimeter of the first baffle, and a plurality of inner baffles spaced apart along the length of the inner chamber between the first baffle and an exit end of the suppressor. The side wall of the first baffle is configured to direct a flow of gases received from the firearm through the plurality of apertures at the outer perimeter of the first baffle, and the side wall of each inner baffle is an asymmetric side wall.

18 Claims, 6 Drawing Sheets

(56) References Cited

U.S. PATENT DOCUMENTS

2021/0041200 A1* 2/2021 Kras ..... F41A 21/30

OTHER PUBLICATIONS

Written Opinion of the International Searching Authority dated Jan. 29, 2020 in International Application No. PCT/NZ2019/050153.

* cited by examiner

SUPPRESSOR FOR A GUN

CORRESPONDING APPLICATIONS

This application is a continuation application of U.S. application Ser. No. 16/768,561, which is a national phase entry application of international patent application PCT/NZ2019/050153, which is based on the provisional specification filed in relation to New Zealand Patent Application Number 748689, the entire contents of which are incorporated herein by reference.

TECHNICAL FIELD

The present invention relates to suppressors for guns.

BACKGROUND ART

A gun is a device that uses the expansion of a gas to propel a projectile. The gas can take several forms, such as compressed air stored in a canister attached to the gun. Firearms are a sub-type of gun that use the expansion of a gas created by combustion to propel a projectile. A combustible material such as gun powder is stored within a projectile cartridge. A firing mechanism in the firearm is used to ignite the combustible material. The combustion process creates the gas. The heat of combustion increases the temperature of the gas, which causes it to expand to an area of lower pressure.

The primary exit from the firearm is through the open end of the gun barrel. As a result, the gas expands towards the open end of the firearm barrel. That expansion is transferred to the projectile, propelling it out from the firearm barrel. The creation and expansion of the gas is a fast process. Accordingly, the projectile exits the firearm barrel at high speed.

The generation and expansion of the gas also creates significant noise in the form of a blast wave.

That blast wave is undesirable for a number of reasons. Firstly, the blast wave creates a loud noise, which can damage a person's ears. Repeated exposure to blast waves will result in hearing loss. Secondly, the noise of the blast wave makes the use of guns unpleasant. That may be relevant where people use guns for recreational purposes such as target shooting. Thirdly, the blast wave can create a safety hazard. For instance, police may use guns around volatile gases such as those present in meth labs, or the flash and noise may attract enemy fire.

Devices called suppressors or silencers are used to control the gas expansion and thereby minimise the adverse effects it creates.

One common type of suppressor is a device which is configured to be attached to the end of a gun barrel. These devices include an inlet and an outlet, and a connecting passageway. In-use a projectile fired by the gun passes through the inlet, along the passageway, exiting the suppressor via the outlet.

These suppressors include a series of internal baffles which define chambers within the suppressor. The gas generated during firing of the projectile is able to expand into the chambers. The chambers are arranged such that a first chamber is comparatively larger than the volume of the gun barrel. Accordingly, the first chamber provides a large volume into which the gas may expand. The gas can subsequently expand into adjacent chambers in the suppressor. Together, the chambers facilitate a gradual expansion of the gas. As a result, the expansion of the gas is slower than were the suppressor not used, which minimises the noise created by the blast wave.

There are numerous arrangements for baffle structures and configurations in gun suppressors. Many of these are successful in reducing the noise on firing of a gun. However, no known suppressor yet completely removes all noise created on firing of a gun. It would be advantageous to have a gun suppressor having a baffle structure which may further reduce the noise created on firing of a gun in comparison to existing suppressors.

A suppressor creates a sustained and increased pressure within the system of a firearm longer than the firearm system was designed for. An increased back pressure in the firearm has been recognized as a suppressor drawback for a hundred years. The sustained increased pressure can result in several drawbacks. The sustained increased back pressure can cause an increase in firearm bolt velocity. The increase pressure within the firearm system causes the firearm bolt to move to the rear of the firearm system faster than it was designed, potentially causing a violent extraction of the projectile cartridge from the chamber of the firearm. In a worst-case scenario, the projectile cartridge, due to being thrown violently rearwards, can get jammed in the chamber of the firearm. Furthermore, when the cartridge is ejected from the chamber of the firearm, the pressure within the firearm system has not yet reduced to normal levels via the muzzle of the firearm, which can cause a blowback of higher pressure gases together with combustion debris into or towards the face of the user.

Improved sound suppression can be achieved by increasing the volume of the suppressor, for example by increasing the diameter and/or length of the suppressor. There is a practical limit on the diameter of a suppressor in order for a user to sight the firearm at a target. An increased length essentially lengthens the barrel of the firearm, making the firearm more cumbersome to use. There is therefore a tradeoff between suppressor volume/length and suppressor effectiveness.

Dual flow suppressors have been designed to improve suppression while also attempting to reduce back pressure. A dual flow suppressor is a suppressor in which the flow of gases through the suppressor are split into two parallel flow paths through the suppressor. An early example of a suppressor with an inner flow path and an outer flow path is provided by U.S. Pat. No. 1,017,003. However, a problem with dual flow suppressors is that most (if not substantially all) of the flow of gases through the suppressor will follow the larger projectile pathway through the suppressor with little flow via the outer parallel flow path. The outer flow path therefore does not result in a significant improvement in suppressor performance for a given suppressor volume.

Accordingly, in light of the foregoing it would be advantageous to have an improved suppressor which addresses any one or more of the foregoing problems.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

DISCLOSURE OF THE INVENTION

It is an object of the present invention to address one or more of the foregoing problems or at least to provide the public with a useful choice.

To avoid an increase in firearm system pressure and subsequent increased bolt velocity and blowback caused by the use of a suppressor on a firearm, the inventor considers that the flow of gases from the firearm system and sound suppression of those gases must occur within the time period between the moment the gases begin entering the suppressor after the firearm has been fired and the moment the firearm bolt starts to open to release the projectile cartridge from the chamber of the firearm. This time period from gases entering the suppressor to the bolt starting to open generally occurs within about 1 millisecond for semi and fully automatic firearms. By comparison, the time period for a full cycle of firing, bolt opening and ejecting the spent cartridge, and loading and firing the next cartridge is in the order of about 100 milliseconds for a fully automatic firearm. Thus, the time period to suppress the gases is about 1% of a firing cycle for a fully automatic firearm.

Inefficient suppressors can allow the gases to exit the firearm system quickly but with a correspondingly poor level of sound suppression. To achieve both effective sound suppression while also allowing the gases to exit the firearm system fast enough to prevent increased pressure at the chamber of the firearm when the bolt opens, the inventor believes the flow of gases through the suppressor must be split into parallel flow paths and with the pressure between those flow paths balanced and/or the velocity of the gases through those flow paths matched. Balanced pressure between the parallel flow paths means there is no or negligible pressure difference between the flow paths along the length of the flow path. By balancing the pressure between the parallel flow paths and/or matching the velocity of gases flow in each flow path, the gases flow from each of the flow paths exits the suppressor at the same time, or in other words, the velocity of the gases through each flow path is approximately the same. This results in a dual or outer flow path that is effective in the suppression of sound.

According to a first aspect of the present invention, there is provided a suppressor for a firearm comprising:

- a fitting for attaching the suppressor to a barrel of a firearm at or towards an inlet end of the suppressor, the fitting providing an inlet to the suppressor,
- an end wall at an exit end of the suppressor, the end wall comprising an outlet and at least one gases outlet aperture, the outlet aligned with the inlet to form a projectile pathway for a projectile to pass through the suppressor,
- a tubular side wall extending between the exit end and the inlet end defining an outer shell,
- a blast chamber within the outer shell adjacent the inlet end,
- a tubular inner wall defining an inner chamber and an outer chamber within the shell,
- the inner chamber providing a gases inner flow path for gases to flow in a forward direction from the blast chamber to the outlet,
- the outer chamber providing a gases outer flow path for gases to flow in the forward direction from the blast chamber to the at least one gases outlet aperture, the outer flow path parallel to the inner flow path,
- wherein the outer chamber is without a counter-flow gases flow path in an opposite rearward direction between the blast chamber and the at least one gases outlet, and
- wherein the suppressor is configured so that gases pressure between the inner chamber and the outer chamber is balanced along the length of the inner and outer chambers so that gases exhaust from the inner and outer chambers via the exit outlet and the outlet apertures at substantially the same time.

In some embodiments, a volume of gases entering the suppressor upon firing the firearm is divided at the blast chamber into a first volume to flow into the outer chamber and a second volume to flow into the inner chamber, and the suppressor is configured so that the first volume of gases that flows into the outer chamber and the second volume of gases that flows into the inner chamber exhaust from the suppressor at substantially the same time.

In some embodiments, the suppressor comprises equalisation holes in the tubular inner wall to allow gases flow from the inner flow path to the parallel outer flow path as gases created by firing the firearm flow and/or expand through the suppressor from the blast chamber to the outlet via the inner flow path and the at least one gases outlet aperture via the parallel outer flow path.

In some embodiments, the equalisation holes in the tubular inner wall are spaced apart along the length of the suppressor.

In some embodiments the suppressor comprises a first baffle. The blast chamber is defined by a portion of the tubular side wall and the first baffle and the inlet end of the suppressor. The first baffle comprises an aperture aligned with the inlet and the outlet on the projectile pathway, the aperture forming an inlet to the inner chamber.

In some embodiments the first baffle is symmetrical.

In some embodiments, the first baffle comprises baffle side wall approximately shaped in the form of a truncated cone with a narrow end oriented towards the inlet end of the suppressor.

In some embodiments, the suppressor comprises one or more inner baffles spaced apart along the length of the inner chamber, each inner baffle extending from the inner wall and comprising a projectile aperture aligned with the inlet and the outlet on the projectile pathway, the inner baffle(s) dividing the inner chamber into a series of inner sub-chambers.

In some embodiments, the suppressor comprises at least one chamber equalisation hole through the tubular inner wall within each sub chamber of the inner chamber.

In some embodiments, one or more sub chambers of the inner chamber comprises at least one equalisation hole adjacent a forward end of the sub-chamber.

In some embodiments, one or more sub chambers of the inner chamber comprises a plurality of equalisation holes spaced circumferentially apart around the tubular inner wall.

In some embodiments, one or more sub chambers of the inner chamber comprises a least four equalisation holes spaced equidistant apart around the circumference of the inner wall.

In some embodiments, one or more of the inner baffles comprises an asymmetric baffle side wall comprising a long side and a diametrically opposite short side. The baffle side wall may be approximately shaped in the form of a truncated asymmetric cone with a narrow end oriented towards the inlet end of the suppressor.

In some embodiments, one or more sub chambers of the inner chamber comprises an equalisation hole in angular alignment with the short side of the baffle side wall.

One or more sub chambers of the inner chamber may additionally or alternatively comprise an equalisation hole in angular alignment with a long side of the baffle side wall.

In some embodiments, one or more sub chambers comprises a plurality of holes arranged together in a group in angular alignment or proximity with a short side of the baffle side wall.

In some embodiments, one or more of the inner baffles has the projectile aperture arranged at an angle to a plane perpendicular to the projectile passageway.

In some embodiments, one or more of the inner baffles comprises an asymmetric baffle side wall comprising a long side and a diametrically opposite short side, and wherein the projectile aperture is angled towards a long side of the baffle side wall.

In some embodiments, one or more of the inner baffles comprises a cowling extending rearwards from the baffle side wall and/or a surface or rim around the projectile aperture, the cowling shaped to direct a portion of a flow of gases at the projectile aperture in a direction orthogonal to the projectile passageway and/or create an area of increased pressure that extents at least partway across the projectile aperture.

In some embodiments, an inner surface of the cowling facing towards the projectile aperture is concave and curves through approximately 90 degrees from parallel to a longitudinal axis of the suppressor at a rear end of the cowling to perpendicular to the longitudinal axis at a forward end of the cowling.

In some embodiments, the baffle side wall extends radially outwards and in a forward direction of the suppressor from adjacent the projectile aperture, and the inner baffle comprises a secondary baffle wall extending radially outwards and in a rearward direction of the suppressor from a rear end of the cowling.

In some embodiments, the secondary side wall extends for a portion of the circumference of the projectile aperture.

In some embodiments, the outer chamber increases in volume in a forward direction through the suppressor.

In some embodiments, the inner chamber decreases in volume in a forward direction through the suppressor.

The tubular side wall may be cylindrical, and the tubular inner wall may be part conical so that the diameter of the inner chamber decreases in a forward direction through the suppressor with a corresponding increase in radial width of the outer chamber in the forward direction through the suppressor.

In some embodiments, the suppressor comprises one or more outer baffles spaced apart along the length of the outer chamber dividing the inner chamber into a series of outer sub-chambers.

In some embodiments, one or more of the outer baffles extend between the tubular side wall and the tubular inner wall.

In some embodiments, the suppressor comprises an outer chamber inlet to receive a flow of gases from the blast chamber into the outer chamber, and wherein a resistance to flow of the inlet is greater than the resistance to flow of a first outer baffle within the outer chamber.

In some embodiments, a resistance to flow of a second outer baffle within the outer chamber is less than a resistance to flow of the first outer baffle, the second baffle located nearer to the exit end of the suppressor than the first baffle.

In some embodiments, one or more rearward outer baffles have a higher resistance to flow than one or more forward outer baffles.

In some embodiments, at least one or more outer baffles imparts a whirling motion circumferentially around the outer chamber.

In some embodiments, at least two outer baffles each imparts a whirling motion circumferentially around the outer chamber, a first whirl baffle imparting a whirling motion in a first circumferential direction and a second whirl baffle imparting a whirling motion circumferentially around the outer chamber in a second circumferential direction.

In some embodiments, the suppressor comprises an outer chamber inlet baffle comprising a plurality of holes providing an outer chamber inlet.

In some embodiments, a flow area of an inlet to the outer chamber is greater than or equal to a flow area of an inlet to the inner chamber.

According to a second aspect of the present invention, there is provided a suppressor for a firearm comprising:

an inner chamber through which a projectile fired by the firearm passes, and an outer chamber parallel to the inner chamber, wherein the outer chamber provides a gases flow path parallel to the inner chamber and including without a counter-flow flow path, wherein the inner chamber comprises one or more baffles to work gases produced by firing the firearm to direct the gases radial outwards of a projectile passageway through the inner chamber, and wherein the suppressor is configured so that pressure between the inner chamber and the outer chamber is balanced along the length of the inner and outer chambers so that gases exhaust from the inner and outer chambers at substantially the same time.

In some embodiments, the suppressor comprises a tubular inner wall separating the inner and outer chambers and equalization holes in the tubular inner wall to allow gases flow between the inner and outer parallel flow paths.

In some embodiments, the suppressor comprises a blast chamber that provides an entry chamber common to both the inner and outer parallel flow paths.

According to a third aspect of the present invention, there is provided a suppressor for a firearm comprising:

a fitting for attaching the suppressor to a barrel of a firearm at or towards an inlet end of the suppressor, the fitting providing an inlet to the suppressor, an end wall at an exit end of the suppressor, the end wall comprising an outlet and at least one gases outlet aperture, the outlet aligned with the inlet to form a projectile pathway for a projectile to pass through the suppressor, a tubular side wall extending between the exit end and the inlet end defining an outer shell, a blast chamber within the outer shell adjacent the inlet end, a tubular inner wall defining an inner chamber and an outer chamber within the shell, the inner chamber providing a gases inner flow path for gases to flow in a forward direction from the blast chamber to the outlet, the outer chamber providing a gases outer flow path for gases to flow in the forward direction from the blast chamber to the at least one gases outlet aperture, the outer flow path parallel to the inner flow path, wherein the outer chamber is without a counter-flow gases flow path in an opposite rearward direction between the blast chamber and the at least one gases outlet, and equalisation holes in the tubular inner wall to allow gases flow from the inner flow path to the parallel outer flow path as gases created by firing the firearm flow and/or expand through the suppressor from the blast chamber to the outlet via the inner flow path and the at least one gases outlet aperture via the parallel outer flow path.

The second and third aspects of the present invention may comprise any one or more features described above in relation to the first aspect of the present invention.

Throughout this specification and claims, unless the context suggests otherwise, 'parallel flow paths' means flow in two or more flow paths is in the same direction, as opposed to counter flow where the flow in one path is in the opposite direction to the flow in another flow path.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

BRIEF DESCRIPTION OF THE DRAWINGS

Further aspects of the present invention will become apparent from the ensuing description which is given by way of example only and with reference to the accompanying drawings in which.

DETAILED DISCUSSION OF THE FIGURES

FIGS. 1 to 13 show a suppressor according to one embodiment of the present invention.

The illustrated suppressor 1 is manufactured using a selective metal melting technique such as laser metal sintering ("LMS") techniques as discussed in the Applicant's earlier patent application U.S. Ser. No. 14/138,441 granted as U.S. Pat. No. 9,102,010, the contents of which are incorporated herein by reference. The suppressor 1 is a monocoque structure with all components formed integrally to at least one other component, therefore together.

Figure 1:
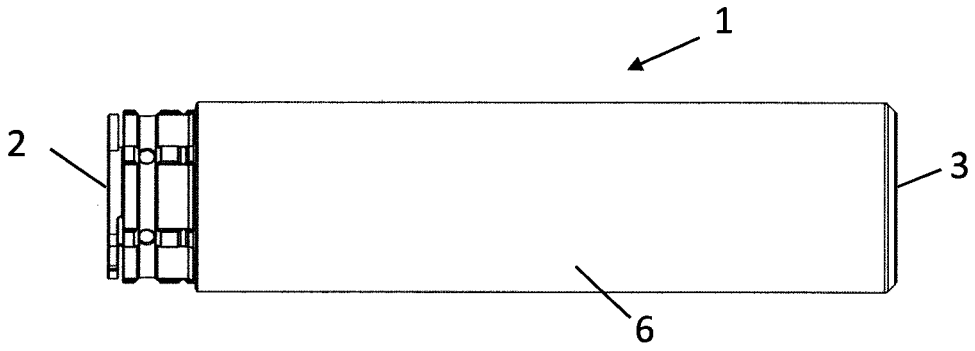
FIG. 1 is a side view of a suppressor according to one embodiment of the present invention.
Figure 2:
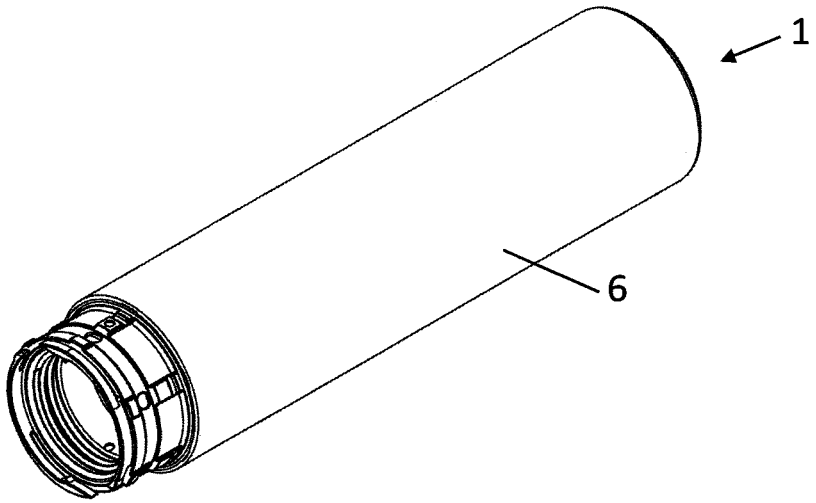
FIG. 2 is a perspective view from an inlet end of the suppressor of FIG. 1.
Figure 3:
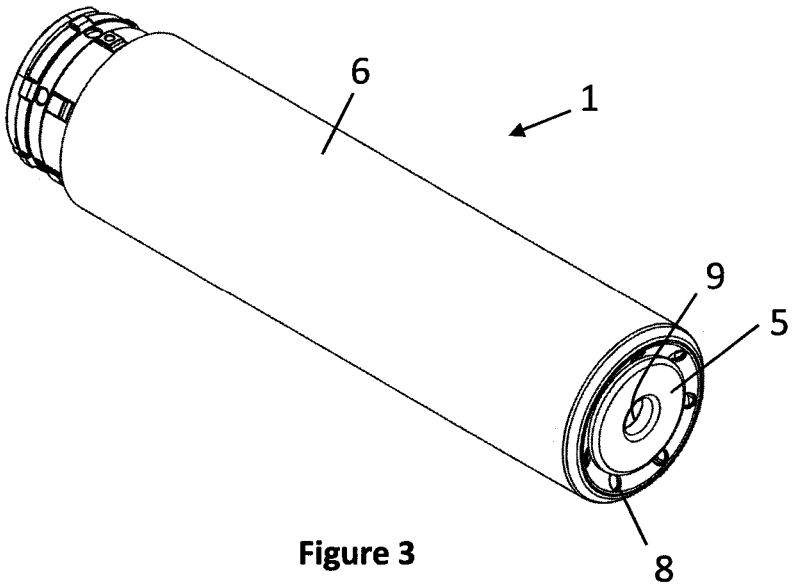
FIG. 3 is a perspective view from an exit end of the suppressor of FIG. 1.
Figure 4:
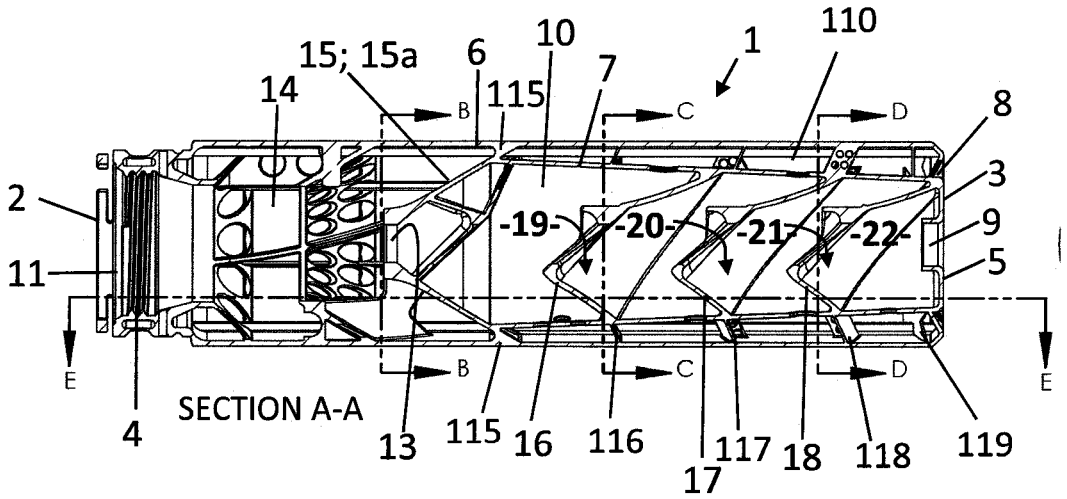
FIG. 4 cross sectional view on arrows A-A in FIG. 10.
Figure 5:
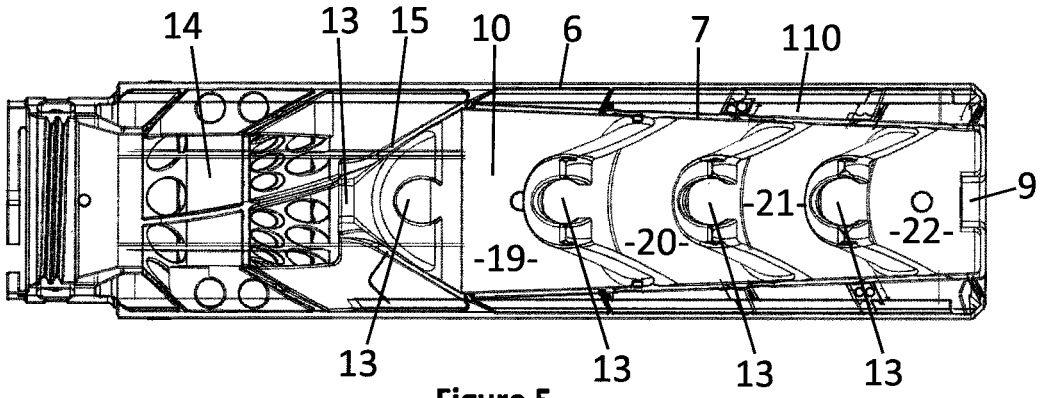
FIG. 5 cross sectional view on the longitudinal centreline of the suppressor on a plane orthogonal to the sectional view of FIG. 4.
Figure 6:
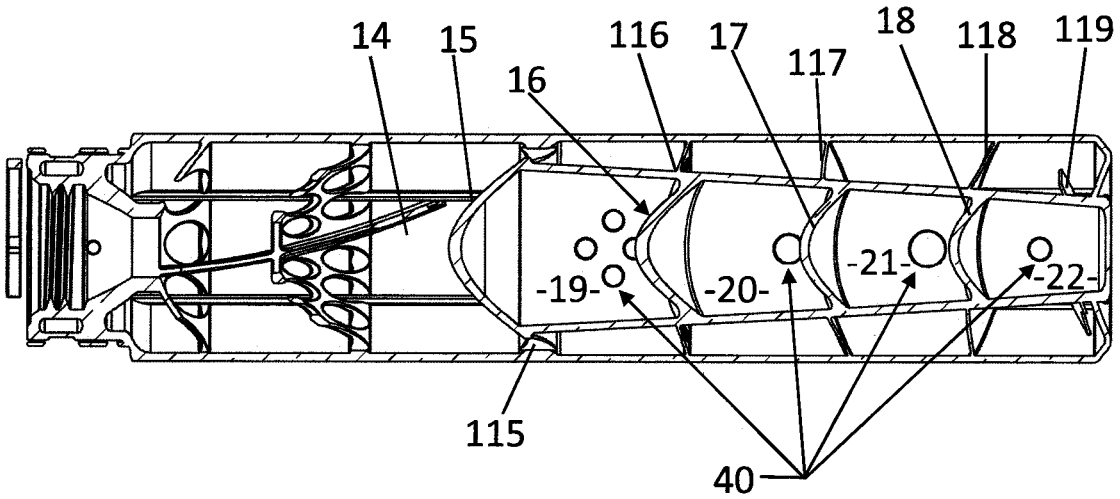
FIG. 6 is cross sectional view on line E-E in FIG. 4.
Figure 7:
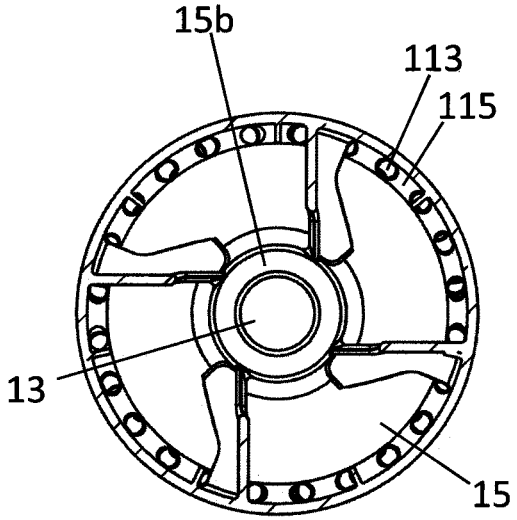
FIG. 7 is cross sectional view of line B-B in FIG. 4.
Figure 8:
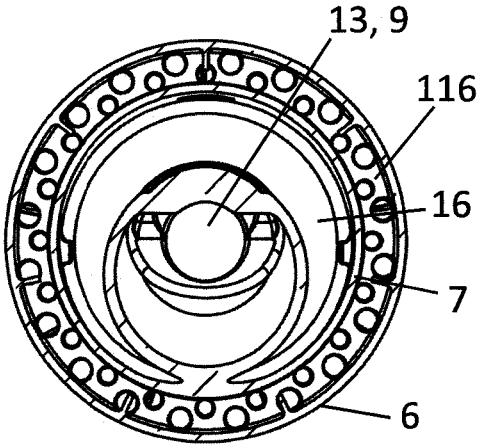
FIG. 8 is a cross sectional view on line C-C in FIG. 4.
Figure 9:
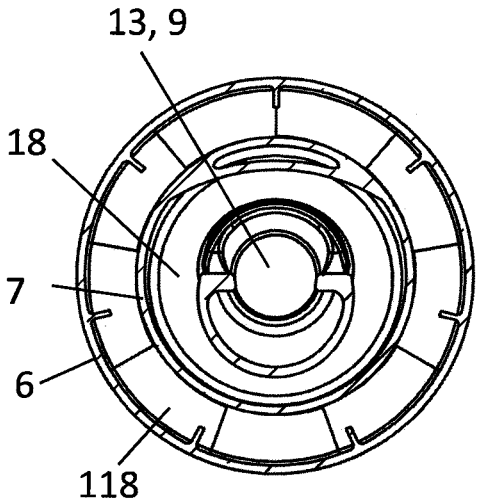
FIG. 9 is cross sectional view on line D-D in FIG. 4.
Figure 10:
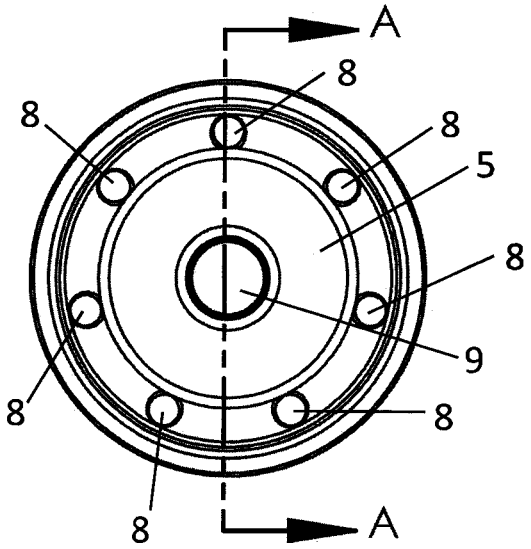
FIG. 10 is an end view on an exit end of the suppressor of FIG. 1.
Figure 11:
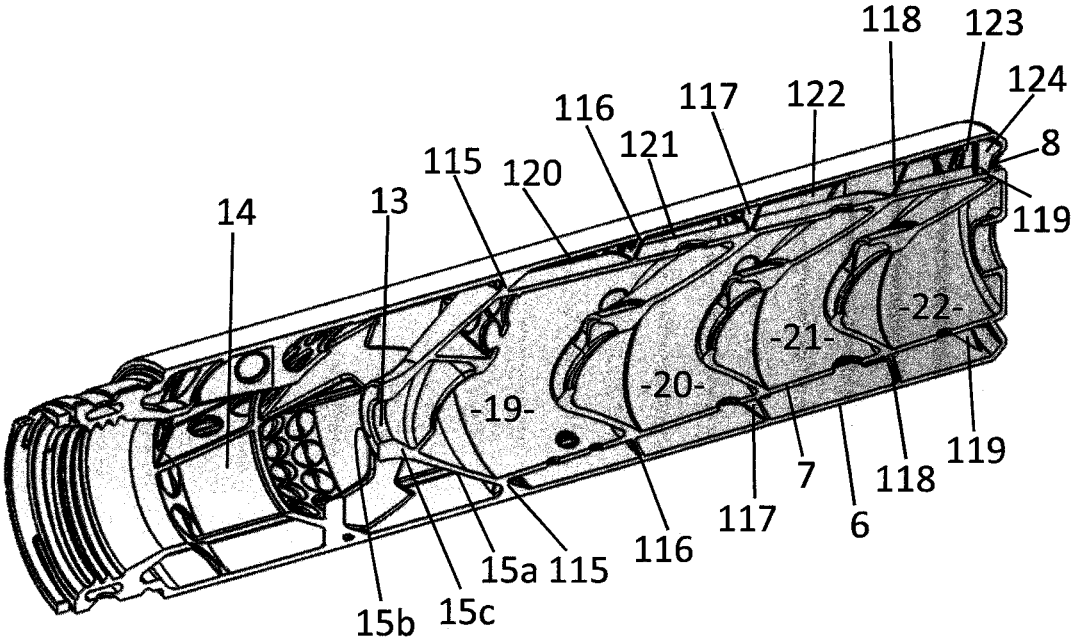
FIG. 11 is perspective view of the suppressor sectioned on the same plane as the cross-sectional view of FIG. 4.
Figure 12:
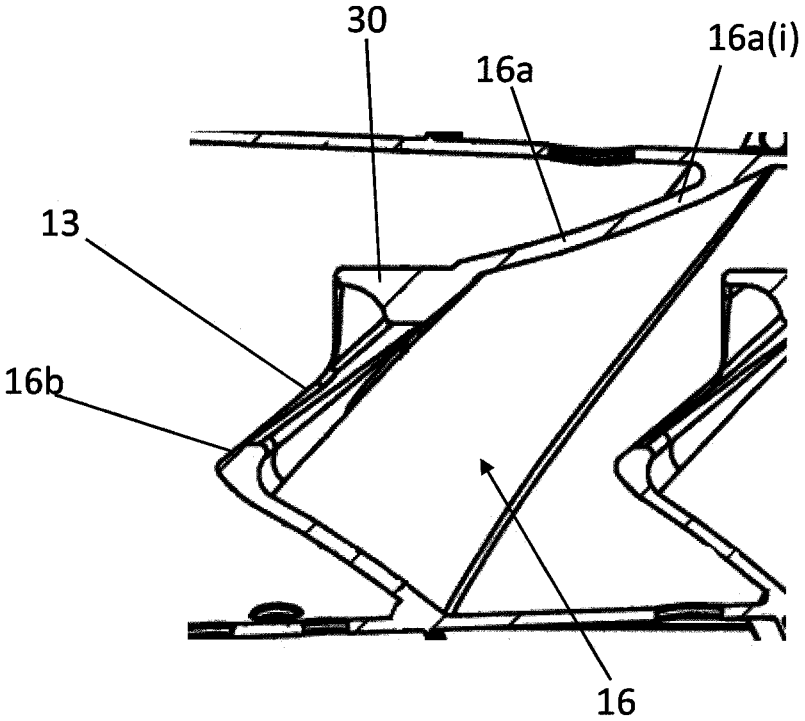
FIG. 12 is an enlarged sectional view on one inner baffle of the suppressor, the sectioned on the same plane as the cross-sectional view of FIG. 4.
Figure 13:
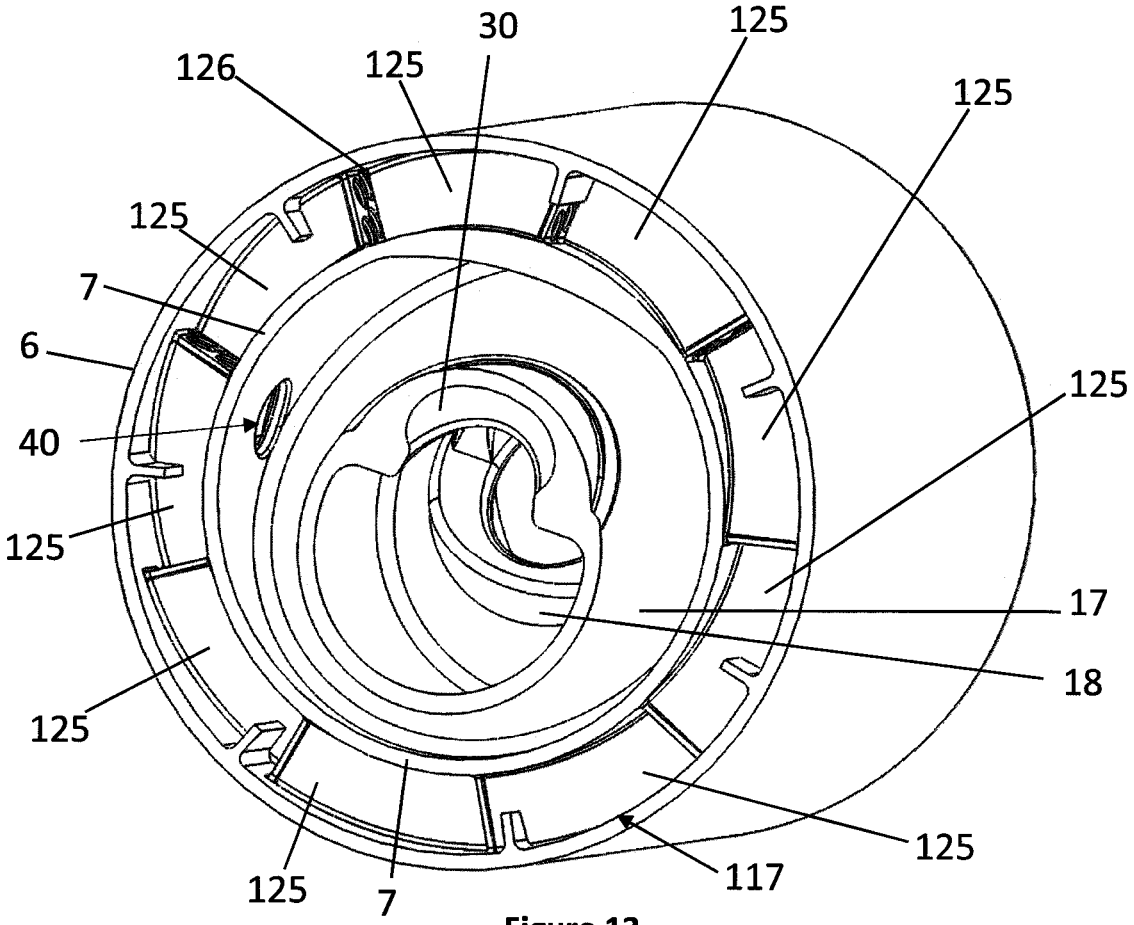
FIG. 13 is an orthogonal sectional view exposing an outer baffle of the suppressor of FIG. 1.

With reference to the cross-sectional views of FIGS. 4 and 5, the suppressor comprises an inner or central chamber 10 and an outer chamber 110. The inner and outer chambers provide for two parallel flow paths. Preferably, as shown, the inner and outer chambers are concentric.

In the illustrated embodiment there are two chambers 10, 110 providing two parallel flow paths, however in alternative embodiments there may be more than two parallel flow paths, for example a central chamber and two or more parallel outer chambers.

The gas flow through or along each flow path is in the same direction, i.e. the flow in each path is generally in a forward direction, from the inlet or aft or rear end 2 of the suppressor 1 to the exit or fore or front end 3 of the suppressor 1. In a suppressor according to the present invention, the suppressor is without a counter-flow flow path, i.e. a path in which gases must flow in a rearwards direction through the suppressor before exiting from the exit end of the suppressor. Structures such as baffles, described in more detail below, within each flow path 10, 110 are not designed to reverse the flow back towards the inlet end 2. According to the present invention, ideally the gases flow throughout each chamber 10, 110 is generally in the forward direction or at least has a forward component, towards the exit end 3 of the suppressor.

The suppressor comprises a fitting 4 to attach the suppressor to the end of a barrel of a firearm. In the illustrated embodiment, the fitting 4 is a screw thread that is a portion of a quick disconnect coupling for attaching to the firearm barrel. Any known fitting may be provided at or towards the inlet end of the suppressor, such as a screw thread to attach directly to the barrel, a Quick Disconnect (QD) fitting/coupling, or other fitting or portion of a fitting or connector. As the fitting attaches the suppressor to a barrel, the fitting essentially provides an inlet 11 to the suppressor.

The suppressor has an end wall 5 at the exit end of the suppressor, and a tubular side wall 6 extending between the end wall 5 and the inlet end 2 of the suppressor to define an outer shell or can. The inner and outer chambers are divided by a tubular inner or intermediate wall 7 radially within the tubular side wall. The tubular side wall 6 and/or tubular inner wall 7 may be cylindrical or otherwise shaped, for example a triangular, octagonal, or other polygon shaped tubular wall. The end wall 5 has a plurality of holes 8 for gases to flow from the outer chamber of the suppressor and a projectile aperture 9, the holes 8 providing an outlet from the outer chamber 110. The outlets 8 are radially outside of the projectile aperture 9. The projectile aperture 9 in the end wall is the only outlet from the central chamber 10 of the suppressor 1. The plurality of holes 8 in the end wall are spaced circumferentially apart. In the illustrated embodiment the combined area of the holes 8 is approximately equal to or is greater than the area of the projectile aperture 9.

A blast chamber 14 is provided within the outer shell adjacent the inlet end 2 of the suppressor 1. The blast chamber 14 is defined or bounded by a portion of the side wall 6 of the suppressor, the inlet end 2 and/or fitting 4 of the suppressor, and a first baffle 15 of the suppressor. In the illustrated embodiment fins are provided to the inside of the blast chamber. These fins are structural elements and are not provided as baffles to work on the gases created by the blast from the projectile cartridge. The fins may include holes as shown to allow for a maximum gases flow from the firearm into the suppressor. The blast chamber is intended to provide an unrestricted chamber to receive gases from the firearm with minimal flow restriction.

The first baffle 15 provides an inlet end wall to the central chamber 10 and divides the central chamber 10 from the blast chamber 14. The inner chamber 10 is defined or bound by the tubular inner wall 7, the end wall 5 and the first baffle 15.

The first baffle is provided with a projectile aperture 13 that is aligned with the inlet 11 to the suppressor and the exit aperture 9 in the end wall 5, to provide a projectile passageway through the suppressor. The projectile aperture 13 in the first baffle 15 forms an inlet to the central chamber 10. The first baffle 15 is preferably without other apertures, such that the projectile aperture 13 is the only aperture directly between the central chamber 10 and the blast chamber 14.

An outer chamber inlet baffle 115 at an inlet end of the outer chamber 110 divides the blast chamber 14 from the outer chamber 110. The outer chamber 110 is defined or bounded by the outer wall 6, the inner wall 7, the inlet baffle 115 and the end wall 8. The term 'inlet baffle' used to describe this feature of the suppressor is used in a general sense. Preferably, the 'inlet baffle' includes many apertures 113 (FIG. 7) that in combination provide an inlet to the outer chamber 110. The 'inlet baffle' may be provided by a number of spaced apart fins or spokes extending between the side wall and the inner wall/first baffle. In the illustrated embodiment, the inlet baffle 115 is positioned in line with the outer perimeter of the first baffle to structurally support the outer perimeter of the first baffle 15 from the side wall 6.

The inner chamber defines an inner flow path and the outer chamber defines a parallel outer flow path. The blast chamber 14 forms an entry chamber common to both the inner flow path 10 and the parallel outer flow path 110. When a firearm is fired, the blast chamber 14 fills with pressurised gases and the first baffle 15 acts on the gases to separate the gases into the two parallel flows, an inner flow through the inner chamber 10 via the aperture 13 of the first baffle 15, and an outer flow through the outer chamber 110 via the inlet 113 to the outer chamber 110. The outer chamber is without a counter-flow gases flow path in an opposite rearward direction between the blast chamber and the at least one gases outlet. The flow through the outer chamber is in the forward direction from the blast chamber to the outlet 8, without flowing via a counter flow path. The inner chamber is also without a counter-flow flow path.

The first baffle 15 preferably directs flow to the outer chamber 110. To achieve this, the first baffle is preferably symmetrical as shown. The first baffle comprises a side wall 15*a* that is generally or approximately shaped in the form of a truncated cone or approximately frusto-conical. The projectile aperture 13 is located at the narrow end of the frustum of the cone shape. The first baffle may include a surface 15*b* (FIGS. 7 and 11) orthogonal to the longitudinal axis of the suppressor (and projectile passageway) with the projectile aperture 13 formed in or through the orthogonal surface. The surface 15*b* may be annular with an outer diameter concentric with the projectile aperture 13. The baffle 15 may include a neck section 15*c* extending from the frusto-conical side wall 15*a*, with the neck section 15*c* forming part of the orthogonal surface through which the aperture 13 is provided. A symmetrical baffle also contributes to projectile stability as the projectile enters the blast chamber under high pressure.

As the gases expand and move forward from the blast chamber 14 the gases hit the rearward facing surfaces of the first baffle 15 and are deflected radially outwards. The gases act on the first baffle as the projectile fired from the firearm enters the projectile aperture 13, effectively blocking the aperture 13 such that the gases pass over the rearward surfaces of the baffle 15 and enter the outer chamber 110 via inlet 113. The projectile quickly 'outruns' the gases, passing out of the suppressor while the gases are still expanding within the blast chamber to enter into the central and outer chambers. In some embodiments, the combined area of the holes 113 of the inlet baffle 115 to the outer chamber 110 is the same as or greater than the area of the projectile aperture 13 of the first baffle 15, to promote gases flow from the blast chamber 14 into the outer chamber 110, with gases also passing into the central chamber 10. In practice, once the projectile outruns the gases, a majority of gases may pass from the blast chamber 14 and into the central chamber 10.

The suppressor comprises one or more inner baffles 16, 17, 18 spaced apart along the length of the central chamber 10. The baffles 16, 17, 18 separate the central chamber 10 into a series of sub chambers 19, 20, 21, 22. Each sub chamber is defined by a baffle at its inlet end, the inner wall 7 and a baffle at its exit end or for the last chamber 22 in the series of sub chambers, the end wall 5. Each baffle includes a projectile aperture 13, with the projectile apertures aligned to provide a projectile passageway through the suppressor. Each baffle 16, 17, 18 extends from the inner wall 7.

To suppress noise preferably the baffles 16, 17, 18 within the central chamber 10 'aggressively' work the gases as the gases move forward through the central chamber 10. Effective sound suppression is achieved by aggressively working the gases to impede the progress of the gases expanding and flowing through the suppressor 1.

In the illustrated embodiment the suppressor comprises three baffles 16, 17, 18 to divide the central chamber 10 into four sub-chambers 19-22 in series. In alternative embodiments the suppressor may comprise one, two or more than three baffles.

In the illustrated embodiment, each baffle 16, 17, 18 within the central chamber 10 comprises an asymmetric sidewall (16*a* FIG. 12) extending radially inwards from the inner wall 7. The baffle side wall extends radially outwards and in a forward direction of the suppressor from adjacent the projectile aperture i.e. from the orthogonal surface adjacent the projectile aperture, to the inside of the inner tubular wall. In the illustrated embodiment, the side wall 16*a* is approximately an asymmetric truncated conical sidewall. A base or wide end of the asymmetric truncated cone section is formed with the inner wall 7 at an angle to a plane perpendicular to the longitudinal axis of the suppressor to place the projectile aperture 13 in alignment with the projectile passageway through the suppressor. Each baffle is arranged with a narrow end of the frustum of the cone shape towards the rear or inlet end of the suppressor, with the narrow end and projectile aperture 13 also at an angle to a plane perpendicular to the longitudinal axis of the suppressor. Each baffle therefore may be described as a slanted or tilted baffle, being arranged non-perpendicular to the central axis of the suppressor or the projectile passageway.

The narrow end of the cone frustum is angled towards the long side 16*a*(*i*) of the frustum side wall 16*a*, i.e. to be approximately parallel to the large end of the frustum connected to the side wall 7. The narrow end may comprise a surface orthogonal 16*b* to the longitudinal axis of the suppressor (and projectile passageway) with the projectile aperture 13 formed in or through the orthogonal surface. In alternative embodiments the baffles may be otherwise shaped, for example comprising a symmetrical truncated cone section which may include a slanted projectile aperture.

The orientation and configuration of the orthogonal surfaces 16*b* and projectile apertures 13 may assist in controlling expansion of gases within the suppressor. For instance, without being limited to a specific mechanism, the inventor postulates that the orientations of these components may assist in directing expansion of gases created on firing a gun radially outwards towards the inner wall 7 between the inner and outer chambers.

As described above, the central chamber should work the gases aggressively to achieve effective sound suppression. To further work the gases in the central chamber, in the illustrated embodiment, each baffle 16, 17, 18 in the central chamber includes a hood, scoop or cowling 30 extending rearward from the orthogonal surface or rim 16*b* about the projectile aperture 13 and/or the side wall 16*a* of the baffle. The cowling 30 is adjacent the projectile aperture 13 through the baffle. The cowling 30 is proximate the long side 16*a*(*i*) of the baffle side wall 16*a*, i.e. the long side of the cone frustum forming the side wall. The cowling extends for a portion of the circumference of the projectile aperture 13 and in the illustrated embodiment approximately half way around the circumference of the projectile aperture 13. The cowling 30 acts to direct a portion of the flow of gases at the projectile aperture in a direction orthogonal to the longitudinal axis of the suppressor. The cowling creates an area of high pressure that extends at least part way across the projectile aperture 13. The area of high pressure creates or causes a 'virtual' wall at least part way across the projectile aperture, which further assists with moving the gases off the central passageway through the suppressor and outwards to the outer chamber. An inner surface of the cowling facing towards the projectile aperture is preferably concave and may curve through approximately 90 degrees from parallel to a longitudinal axis of the suppressor at a rear end of the cowling to perpendicular to the longitudinal axis at a forward end of the cowling.

Figure 14:
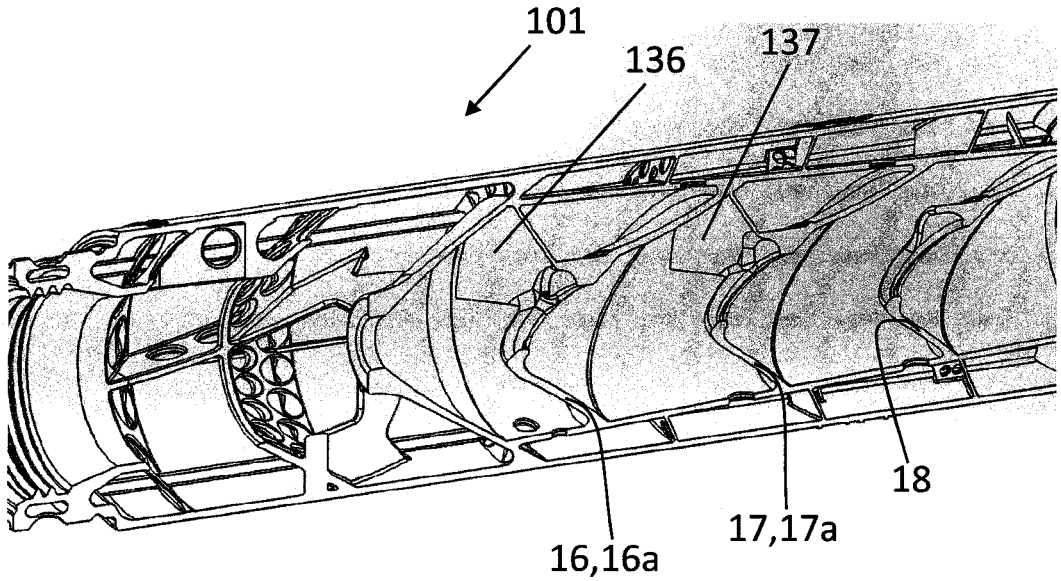
FIG. 14 is perspective view of suppressor according to another embodiment, sectioned on a longitudinal centreline.
Figure 15:
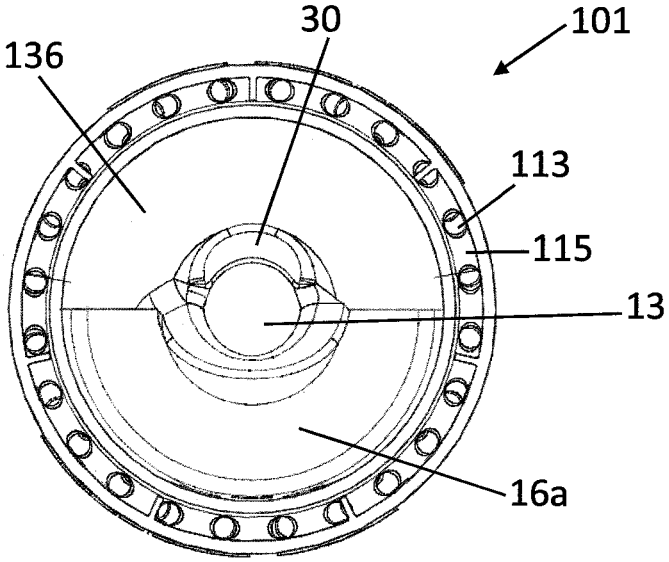
FIG. 15 is a cross sectional view of the suppressor of FIG. 14 on line F-F in FIG. 16.
Figure 16:
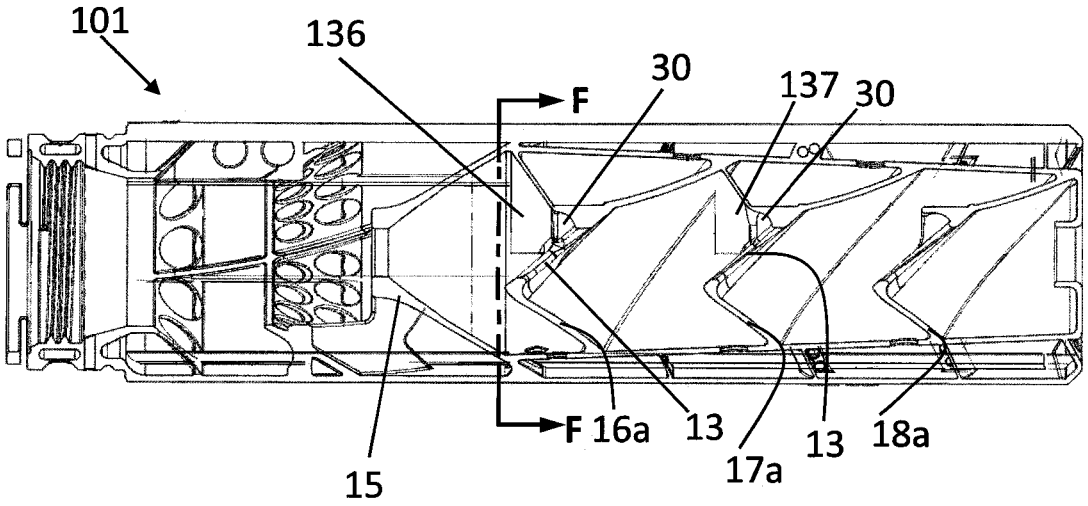
FIG. 16 is cross sectional view of the suppressor of FIG. 14 perspective, sectioned on a longitudinal centreline.

FIGS. 14 to 16 show a suppressor 101 according to another embodiment of the present invention. In some embodiments, and as shown in FIGS. 14 to 16, one or more inner baffles 16, 17 of suppressor 101 comprises a secondary baffle wall 136, 137 extending radially outwards and in a rearward direction of the suppressor from adjacent the projectile aperture to the tubular inner wall 7. The secondary baffle wall may extend from the baffle wall 16*a* described above, and/or the orthogonal surface adjacent the projectile aperture 13. In the illustrated embodiment 101, the secondary baffle wall 136, 137 extends from a rear end of the cowling 30 to the inside of the inner tubular wall 7. The secondary baffle may extend from adjacent the projectile aperture to an upstream inner baffle, e.g. secondary baffle wall 137 may extend to baffle wall 16*a*.

The secondary wall 136, 137 extends for a portion of the circumference of the projectile aperture 13 and in the illustrated embodiment approximately half way around the circumference of the projectile aperture 13.

The secondary baffle wall acts as a funnel to direct a portion of the flow of gases at the projectile aperture 13 in a direction orthogonal to the longitudinal axis of the suppressor. This may assist with creating an area of high pressure that extends at least part way across the projectile aperture 13, to cause a virtual baffle at least part way across the projectile aperture 12, as described above for the cowling. Where the secondary wall extends from the rear edge of the cowling, the secondary wall acts to funnel a portion of the flow of gases to the cowling which then directs the flow to the projectile aperture 13 in a direction orthogonal to the longitudinal axis of the suppressor.

As the secondary baffle wall extends for a portion of the circumference around the projection aperture 13, gases flow in the inner chamber 10 can flow beyond the secondary wall 136, 137 to act against the wall 16*a*, 17*a* of the baffle 16, 17 off the axis of the projectile passageway through the suppressor 101.

Again with reference to the embodiment of FIGS. 1 to 13, to allow the gases to continue to move forward through the suppressor, while working the gases aggressively to slow the gases flow rate to therefore suppress noise emitting from the exit end of the suppressor, in some embodiments the suppressor may comprise equalisation holes 40 in the inner wall 7 dividing the central 10 and outer 110 chambers. The equalisation holes 40 allow for gases to flow from the inner chamber 10 to the outer chamber 110 as the gases flow/expand forward through the suppressor.

The suppressor may comprise at least one chamber equalisation hole 40 through the inner wall 7 within each sub chamber 19-22 of the central flow path. Each equalisation hole 40 is preferably formed towards a forward end of the sub-chamber. The suppressor may comprise a plurality of equalisation holes towards a forward end of one or more sub-chamber, adjacent where the forward baffle of the sub-chamber meets the inner wall, i.e. forward baffle 16 of the first sub-chamber 19. In the illustrated embodiment, the first two sub-chambers 19 and 20 comprise equalisation holes spaced approximately 90 degrees apart around the inner wall 7, at a 12 o'clock, 3 o'clock, 6 o'clock and 9 o'clock positions, wherein a longest side (16*a*(*i*) in FIG. 12) of the asymmetric or truncated cone shaped wall 16*a* of the forward baffle meets the inner wall 7 at the 12 o'clock position. The hole at the 6 o'clock position is in angular alignment with the short side (16*a*(*ii*) in FIG. 12) of the asymmetric wall 16*a* of the baffle, and the hole at the 12 o'clock position is in angular alignment with the long side 16*a*(*i*) of the asymmetric wall of the baffle. The first sub chamber 19 comprises a plurality of holes 40 (refer to FIG. 6) arranged together in a group of holes, and in the illustrated embodiment four holes, at or in proximity to the 6 o'clock position. The third sub-chamber 21 comprises a single equalisation hole at the 6 o-clock position. The fourth sub-chamber comprises a single equalisation hole at the 6 o-clock position in relation to the baffle at the rearward end of the fourth sub-chamber. The hole is positioned approximately midway along the inner wall 7 between the end wall 5 and the baffle.

The inventor postulates that as the gases enter each sub-chamber 19, 20, 21 they flow/expand over the forward baffle of the chamber into a narrow space between the baffle 16, 17, 18 and the inner wall 7 beyond the projectile aperture 13 of the baffle, and then flow from the central chamber to the outer chamber via the equalisation holes 40.

Furthermore, placing the projectile aperture 13 of each baffle at an angle to a plane perpendicular to the longitudinal axis of the suppressor causes the flow to enter each sub-chamber 20, 21, 22 at least partially in a radially outwards direction, for example a direction along/parallel to the short side of the truncated cone shaped section of the baffle, which causes the gases to be directed towards the equalisation hole located at the 6 o'clock position; refer to arrows through the baffle projectile apertures in FIG. 4.

Very soon after firing (less than 100 micro seconds), as the blast chamber fills with gases the pressure in the blast chamber is high. This high pressure results in flow from the blast chamber to the outer chamber via the inlet baffle 115. However, after the initial high pressure in the blast chamber reduces, the blast chamber pressure no longer provides a mechanism to continue to feed gases to the outer chamber or to drive gases forward through the outer chamber. The flow in the outer chamber can therefore stagnate unless measures are taken to keep the flow of gases moving forward through the outer chamber 110.

To promote forward flow along the outer chamber in the forward direction, and/or from the central chamber to the outer chamber, preferably the pressure in the outer chamber 110 reduces in the forward direction. In some embodiments, to promote forward flow of gases in the outer chamber 110 the outer chamber increases in volume in a forward direction through the suppressor, i.e. the outer chamber increases in volume towards the exit end 3 of the suppressor 1. As the volume of the outer chamber increases, the pressure within the chamber is reduced. This assists in moving gases forwards through the suppressor via the outer chamber 110 while also working the gases effectively within the central chamber 10. The inventor postulates that to achieve both effective sound suppression while at the same time removing as much gases and therefore pressure as possible from the suppressor and firearm system prior to bolt opening, it is important to remove as much of the gases flow off the projectile passageway of the suppressor as possible to the outer chamber 110 while balancing the pressure between the inner and outer chambers so that the gases exit the inner and outer chambers at the same time. The suppressor must be arranged so that the outer flow does not exit the suppressor significantly before the inner flow and vice versa. For example, in one embodiment the outer flow exits the suppressor within 100 micro seconds of the inner flow exiting the suppressor. In some embodiments, the outer flow exits the suppressor within 80 micro seconds, or within 60 micro seconds, or within 50 micro seconds of the inner flow exiting the suppressor. The inner and outer flows should exhaust in substantially the same time period. The inner and outer flows should begin exiting the suppressor at substantially the same time and complete exiting the suppressor at substantially the same time. For example the outer flow should begin exiting the suppressor within 100 micro seconds or less of the inner flow beginning to exit the suppressor, and the outer flow should have completely exhausted from the suppressor within 100 microseconds of the inner flow having completely exhausted from the suppressor. These timings may be within 80 micros seconds, or within 60 micro seconds, or within 50 micro seconds.

With an increasing volume of the outer chamber 110 from the inlet end 2 to the exit end 3 of the suppressor, there may be a corresponding reduction in volume in the central chamber 10, from the inlet end 2 to the exit end 3 of the suppressor. For example, where the outer wall 6 is cylindrical, the inner wall 7 may be part conical in shape so that the diameter of the inner chamber 10 reduces from the inlet end towards the exit end of the suppressor, with a corresponding increase in radial width of the outer chamber 110 from the inlet end to the exit end of the suppressor. A reducing volume in the forward direction for the inner chamber 10 may also assist with moving gases off the central passageway of the suppressor to the outer chamber 110 via equalisation holes 40 through the inner wall 7. The reducing volume of the central chamber may work to cause an increasing pressure in the inner chamber the forward direction which causes flow to the outer chamber to balance pressure between the inner and outer chambers. In an alternative embodiment, the volume of the central chamber may be approximately constant along the length of the suppressor (not accounting for volume taken up by baffle material within the chamber). For example, the inner wall 7 may be cylindrical, and the outer wall 6 may be conical with an increasing diameter towards the exit end 5 of the suppressor as shown in the Figures.

In the illustrated embodiment, the outer chamber 110 comprises one or more outer baffles 116 to 119 (FIG. 11) dividing the outer chamber 110 into a series of sub-chambers 120 to 124. In the illustrated embodiment there are four baffle arrangements in the outer chamber, however in alternative embodiments, there may be one, two, three or more than four baffles.

As described earlier, the inventor believes that it is important to direct gases received in the blast chamber to the outer chamber. To allow for this, the inlet 113 to the outer chamber has an area equal to or greater than the area of the projectile aperture 13 of the first baffle. Also, as described above, the inventor believes that it is preferable to balance pressure (i.e. reduce pressure differential) between the inner and outer chambers. To assist with this the inventor believes it is necessary to include baffles within the outer chamber to slow down the flow of gases in the outer chamber in the forward direction by increasing the resistance to flow through the outer chamber in the forward direction. So while it is important to divert maximum flow to the outer chamber and to maintain a forward flow by creating a reducing pressure in the outer chamber in the forward direction, it is equally important to ensure the outer flow does not exit the outer chamber and suppressor too quickly before the inner flow exits the suppressor. Doing so can result in less effective sound suppression and/or reduced flash suppression.

The first outer baffle 116 in the outer chamber has a lower resistance to flow than the inlet baffle 115. As mentioned above, very soon after firing, as the blast chamber fills with gases, the pressure in the blast chamber is high, and the pressure in the outer chamber is low. The gases therefore flow through the inlet baffle 115 into the outer chamber 110. Since the pressure in the blast chamber is initially high, gases flow into the outer chamber even where the inner baffle 115 presents a relatively high resistance to flow. Furthermore, the blast chamber is preferably sized so that most of the gases remain behind the projectile as the projectile progresses through the blast chamber and into the inner chamber 10, further providing a mechanism to divert maximum flow to the outer chamber 110. As the outer chamber fills with gases, the pressure differential across the inlet baffle 115 between the blast chamber 14 and the outer chamber drops 110. As the gases expand and/or flow along the outer chamber, since the inlet baffle has a higher resistance to flow than the first baffle, the inlet baffle acts to prevent a reverse flow from the outer chamber and back into the blast chamber (and subsequent flow in to the inner chamber).

The second baffle 117 may provide a lower resistance to flow than the first baffle 116. Additionally or alternatively, and as shown in the illustrated embodiment, the second baffle comprises a plurality of blades 125 (refer FIG. 13) arranged circumferentially to impart a swirl or whirl direction to the gases to cause the gases to move forward through the outer chamber 110 with a swirling or whirling motion circumferentially around the outer chamber in a first circumferential direction, i.e. an anti-clockwise direction in an end view on the rear or inlet end of the suppressor. The swirling flow is considered to be parallel to the inner flow path since the swirling flow maintains a forward flow component and without a rearward flow component.

The third baffle 118 also comprises a plurality of blades arranged circumferentially to impart a swirl or whirl direction to the gases, however are arranged to cause a swirling or whirling motion circumferentially around the outer chamber 110 in a second circumferential direction opposite to the first direction, i.e. in a clockwise direction in an end view on the rear or inlet end of the suppressor.

The second and third baffles 117, 118 in the outer chamber 110 therefore create a circumferential tortuous path which aids in a further slowing of the gases in a forward direction through the outer chamber. The effect of the swirling motion is to increase the flow path of the gases through the outer chamber.

In the illustrated embodiment, the fourth and last outer baffle 119 comprises a plurality of blades arranged circumferentially to impart a swirl or whirl direction to the gases to cause the gases to move forward through the outer chamber with a swirling or whirling motion circumferentially around the outer chamber in the first circumferential direction, to further extend the circumferential tortuous path of the gases through the outer circumferential direction.

The second and third baffles 117, 118 comprise a wall 126 (refer FIG. 13) extending in the longitudinal direction of the suppressor between tips of blades 125, with holes through the walls. In other embodiments, suppressor may be without such walls between the blades. The fourth baffle 119 is without a wall between adjacent blades. The walls 126 with holes may be provided to further restrict flow while providing blades 125 with sufficient helical travel in the longitudinal direction to impact a whirling motion with a forward component.

In some embodiments, the outer baffles are aligned with the inner baffles to increase structural strength of the suppressor. As the inner baffles are slanted or tilted, one side of an inner baffle is aligned with one of the outer baffles, and an opposite side of the inner baffle is aligned with the next outer baffle towards the exit end of the suppressor. For example, in FIG. 4, one side of the first inner baffle 16 is aligned with the first outer baffle 116, and the opposite side of the first inner baffle 16 is aligned with the second outer baffle 117.

In the last portion of the suppressor, the inner flow through the last portion of the inner chamber 10 (i.e. the flow through the last sub chamber 22 does not make effective use of the volume of the last sub chamber 22 because the gases are close to the exit aperture 9 and therefore tend to pass straight out the exit end of the suppressor. Consequently, the suppressor benefits from an increased volume in the outer chamber 110 flow path to draw more flow from the inner chamber 10 to the outer chamber 110. However, as described above, the forward flow velocity in the outer chamber may be slowed by creating circumferential flow in the outer chamber.

As described above the inventor believes to achieve effective sound suppression while also avoiding excessive pressure with the firearm system causing violent bolt opening and/or blowback the suppressor should be configured to direct gases flow into the outer chamber and as much gases off the projectile passageway as possible, and to balance pressure between the inner chamber and outer chamber along the length of the suppressor, or in other words match/balance the velocity/rate of gases flow along the inner and outer chambers, so that the gases exit from the inner and outer chambers at the same time.

In some embodiments the inner and outer chambers are sized and configured including balancing of pressures between the inner and outer chambers so that the inner and outer chambers work the gases so that the gases exit the inner and outer chambers approximately at the same time. The gases may initially exit the inner chamber before the outer chamber, however flow through the outer chamber may 'catch up' with gases subsequently exiting the outer chamber more quickly than the inner chamber, with finally all gases exhausted from the inner and outer chambers in substantially the same time period. The end result in the balancing of the flow through the inner and outer chambers is that the gases exhaust from the inner and outer chambers via the exit outlet 9 and the outlet apertures 8 at approximately at the same time. In some embodiments the volume or flow rate of gases through the outer chamber is balanced or equal to the volume or flow rate of gases through the inner chamber. However, more or less volume and therefore flow may pass through the outer chamber than the inner chamber, but all gases flow/volume should be exhausted from the inner and outer chambers in approximately the same time and in the same time period.

A projectile cartridge produces a volume of gas on firing. This volume of gas flows through the suppressor. The volume of gas is split or divided at the blast chamber into two parts, a first volume to flow into the outer chamber and a second volume to flow into the inner chamber. The first volume of gases entering the outer chamber may be equal to the second volume of gases entering the inner chamber or may be more than or less than the second volume of gases entering the inner chamber. However, the first volume of gases that flows into the outer chamber should exit the suppressor in substantially the same time period as the second volume of gases that flows into the inner chamber. As described earlier, the suppressor comprises equalisation holes to balance pressure between the inner and outer chambers. These holes can for example allow flow from the inner chamber to the outer chamber along the length of the suppressor. Thus, flow that entered the inner chamber from the blast chamber may flow through one or more equalisation holes 40 to flow through a portion of the outer chamber 110 and exit the suppressor via the outlet apertures 8. In some embodiments, substantially all of the volume/flow of gases entering the outer chamber 110 from the blast chamber flows through the outer chamber and exits the outer chamber via the outlet apertures 8. In some embodiments, a portion of the volume/flow of gases entering the inner chamber 10 exits the suppressor via the exit outlet 9 and a portion exits the suppressor via the outlet apertures 8.

To achieve a balancing of pressure between the inner and outer chambers and/or matching the flow velocity/rate along the inner and outer chambers so that the inner and outer flows exit the suppressor at the same time may require a process of trial and error, to 'tune' the suppressor to match the pressure and/or velocity/flow rate of gases between and the parallel flow paths provided by the inner chamber and outer chamber. Balancing pressure/flowrate/velocity between the inner and outer chambers along the length of the suppressor to ensure the inner and outer flows exit the suppressor at the same time may require a slowing down of the forward flow of gases in the outer chamber, such that the gases can still be aggressively worked by the baffles in the inner chamber while allowing for pressure/flowrate/velocity matching between the two parallel flow paths. 'Matching rates/velocities means the flow rate/velocity in each flow path result in the inner and outer flows exiting the suppressor at the same time. The outer flow may be higher or lower than the inner flow while being 'matched' with the inner flow to exit the suppressor at the same time as the inner flow.

To develop a suppressor the inventor recommends building a suppressor with an inner chamber and outer chamber as described, with one or more inner baffles in the inner chamber to work the gases to achieve effective noise reduction, and with one or more outer baffles in the outer chamber. If the suppressor results in a gases flow in the outer chamber that is higher flow and/or lower pressure than the gases flow in the inner chamber, modifications should be made to the forward most baffles in the outer chamber, e.g. baffles three, four and five, 117, 118 and 119, in the illustrated embodiment, to slow the rate of gases flowing though the outer chamber, to achieve pressure/flow balancing between the inner and outer chambers.

Modifications can include introducing whirl baffles and a circumferential tortuous path. The number and size of equalisation holes 40 in the tubular inner wall may also be adjusted until the desired balancing affect is achieved. The inventor has disclosed herein arrangements to achieve a balancing between the inner and outer chambers 10 and 110, including:

1. Flow area through the inlet baffle 115 to the outer chamber 110 is equal to or greater than the flow area into the inner chamber 10 to promote flow from the blast chamber 14 initially into the outer chamber 110,
2. The inlet baffle to the outer chamber has a higher resistance to flow than the first outer baffle in the outer chamber,
3. Imparting a swirling motion to the gases in the outer chamber to reduce the flow velocity in the forward direction,
4. Imparting alternative circumferential swirling motion to the gases to create a tortuous circumferential flow path in the outer chamber,
5. Introducing equalisation holes 40 in the tubular inner wall between the inner and outer chambers,
6. Altering size and number of equalisation holes 40 in the tubular inner wall.

In an ideal suppressor the inner and outer flow paths would be designed to achieve matched/balanced/uniform pressure/flow velocity between the inner and outer flow paths 10, 110 without equalization holes through the inner wall 7. However, due to different ammunition characteristics and powder used, equalization vents 40 allow for flexibility to accommodate a wider range of ammunition than a suppressor without equalization holes with a single calculated flow path optimized for a single ammunition type.

The effect of moving flow from the inner chamber to the outer chamber has the effect of keeping the overall suppressor volume small while achieving effect sound suppression. Since the gases are processed through the inner and outer chambers equally for flow restriction, volume and pressure, improved sound suppression can be achieved in a shorter time frame. Testing has indicated a suppression time of around half of the suppression time of prior art suppressors. This results in reduced back pressure and allows the suppressor pressure to drop before the firearm bolt automatically opens. A sound suppressor according to the present invention is therefore particularly useful for semi and fully automatic firearms. Such a suppressor may not benefit firearms with a manual bolt system.

Aspects of the present invention have been described by way of example only and it should be appreciated that modifications and additions may be made thereto without departing from the scope thereof as defined in the appended claims.

While the invention has been described in connection with what are presently considered to be the most practical and preferred embodiments, it is to be understood that the invention is not to be limited to the disclosed embodiments. On the contrary, it is intended that the specification covers various modifications and equivalent arrangements included within the spirit and scope of the invention. Also, the various embodiments described above may be implemented in conjunction with other embodiments, e.g., aspects of one embodiment may be combined with aspects of another embodiment to realize yet other embodiments, Further, each independent feature or component of any given assembly may constitute an additional embodiment.

What I claim is:

1. A suppressor for a firearm comprising:

an inner chamber through which a projectile fired by the firearm passes along a projectile pathway through the suppressor, a first baffle comprising a side wall and a projectile aperture aligned with the projectile pathway, and a plurality of apertures at an outer perimeter of the first baffle, a plurality of inner baffles spaced apart along the length of the inner chamber between the first baffle and an exit end of the suppressor, each inner baffle comprising a side wall and a projectile aperture aligned with the projectile pathway, wherein the side wall of the first baffle is configured to direct a flow of gases received from the firearm through the plurality of apertures at the outer perimeter of the first baffle, and the side wall of each inner baffle is an asymmetric side wall.

2. The suppressor as claimed in claim 1, wherein one or more of the inner baffles comprises a cowling extending rearwards from the baffle side wall and/or a surface or rim around the projectile aperture, the cowling shaped to direct a portion of a flow of gases at the projectile aperture in a direction across or orthogonal to the projectile passageway and/or create an area of increased pressure that extents at least partway across the projectile aperture.

3. The suppressor as claimed in claim 2, wherein an inner surface of the cowling facing towards the projectile aperture is concave.

4. The suppressor as claimed in claim 3, wherein the inner surface of the cowling curves from parallel to a longitudinal axis or the projectile passageway of the suppressor at a rear end of the cowling to perpendicular to the longitudinal axis or projectile passageway at a forward end of the cowling.

5. The suppressor as claimed in claim 1, wherein the baffle side wall of each inner baffle extends radially outwards and in a forward direction of the suppressor from adjacent the projectile aperture, and one or more of the inner baffles comprises a secondary baffle wall extending radially outwards and in a rearward direction of the suppressor from a rear end of the cowling.

6. The suppressor as claimed in 5, wherein the secondary side wall extends for a portion of the circumference of the projectile aperture.

7. The suppressor as claimed in claim 1, wherein the asymmetric side wall comprises a long side and a diametrically opposite short side.

8. The suppressor as claimed in claim 6, wherein the baffle side wall is approximately shaped in the form of a truncated asymmetric cone with a narrow end of the truncated asymmetric cone oriented towards an inlet end of the suppressor.

9. The suppressor as claimed in claim 1, wherein one or more of the inner baffles has the projectile aperture arranged at an angle to a plane perpendicular to the longitudinal axis or projectile passageway.

10. The suppressor as claimed in claim 9, wherein one or more of the inner baffles comprises an asymmetric baffle side wall comprising a long side and a diametrically opposite short side, and wherein the projectile aperture is angled towards the long side of the baffle side wall.

11. The suppressor as claimed in claim 2, wherein one or more of the inner baffles has the projectile aperture arranged at an angle to a plane perpendicular to the longitudinal axis or projectile passageway, and the projectile aperture is angled towards the cowling.

12. The suppressor as claimed in claim 1, wherein the side wall of the first baffle is configured to separate the flow of gases into an inner flow through the projectile aperture and an outer flow through the plurality of apertures at the outer perimeter of the first baffle.

13. The suppressor as claimed in claim 1, wherein the side wall of the first baffle is symmetrical.

14. The suppressor as claimed in claim 13, wherein the side wall of the first baffle is approximately shaped in the form of a truncated cone with a narrow end oriented towards an inlet end of the suppressor.

15. The suppressor as claimed in claim 1, wherein a combined area of the plurality of apertures at the outer perimeter of the first baffle is the same as or greater than an area of the projectile aperture of the first baffle.

16. The suppressor as claimed in claim 1, wherein the suppressor comprises a blast chamber to receive the flow of gases from the firearm, the blast chamber defined between an inlet end and/or fitting of the suppressor and the first baffle, the blast chamber bounded by the inlet end and the first baffle.

17. The suppressor as claimed in claim 1, wherein the suppressor comprises a tubular inner wall defining the inner chamber and a parallel outer chamber, and wherein the first baffle is configured to direct the flow of gases through the plurality of apertures into the outer chamber.

18. The suppressor as claimed in claim 17, wherein the inner chamber provides an inner flow path and the outer chamber provides an outer flow path, and wherein the suppressor comprises equalisation holes in the tubular inner wall between the inner flow path and the outer flow path.

* * * * *